US012352551B2

(12) United States Patent
Roberts et al.

(10) Patent No.: US 12,352,551 B2
(45) Date of Patent: Jul. 8, 2025

(54) DETONATING CORD DEPTH LOCATING FEATURE

(71) Applicant: Halliburton Energy Services, Inc., Houston, TX (US)

(72) Inventors: Courtney Ann Thain Roberts, Alvarado, TX (US); Kevin Cook, Alvarado, TX (US); Cynthia Anne Kane, Alvarado, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 133 days.

(21) Appl. No.: 18/239,281

(22) Filed: Aug. 29, 2023

(65) Prior Publication Data

US 2024/0102781 A1 Mar. 28, 2024

Related U.S. Application Data

(60) Provisional application No. 63/409,701, filed on Sep. 23, 2022.

(51) Int. Cl.
*F42D 1/04* (2006.01)
*E21B 43/1185* (2006.01)

(52) U.S. Cl.
CPC ..... *F42D 1/043* (2013.01); *E21B 43/1185* (2013.01)

(58) Field of Classification Search
CPC ..... E21B 43/11; E21B 43/118; F42B 3/26; F42D 1/043
See application file for complete search history.

(56) References Cited

U.S. PATENT DOCUMENTS 4,539,909 A * 9/1985 Day ..... F42B 3/26 102/275.9
4,703,986 A 11/1987 McCormick
4,718,345 A * 1/1988 Yunan ..... F42D 1/04 102/275.12

(Continued)

FOREIGN PATENT DOCUMENTS

CN 113669035 11/2021
DE 102021108869 11/2021

(Continued)

OTHER PUBLICATIONS

Halliburton. Velocity™ Perforating System Improved Surface Efficiency and Downhole Reliability. Halliburton, 2017. H012737 Dec. 2017. PDF file. 1 page.

(Continued)

*Primary Examiner* — Joshua E Freeman
(74) *Attorney, Agent, or Firm* — John Wustenberg; C. Tumey Law Group PLLC

(57) ABSTRACT

A detonator housing facilitates assembly of detonator components of a perforating gun. In an example, the detonator housing comprises a housing body configured for coupling to a charge tube of a perforating gun. A detonator receptacle is formed on the housing body for receiving a detonator. A detonating cord receptacle is formed on the housing body adjacent the detonator receptacle for receiving an end portion of a detonating cord in an overlapping relationship with the detonator. A detonating cord stop is formed on the detonating cord receptacle to limit an insertion depth of the detonating cord within the detonating cord receptacle.

19 Claims, 14 Drawing Sheets

(56) References Cited

U.S. PATENT DOCUMENTS

| | | | | |
|---|---|---|---|---|
| 4,778,404 | A | 10/1988 | Pass | |
| 5,201,598 | A * | 4/1993 | Tehan | E04H 15/60 403/372 |
| 5,775,419 | A | 7/1998 | Gramlich | |
| 6,059,595 | A | 5/2000 | Lacrouts-Cazenave | |
| 6,112,813 | A | 9/2000 | Head | |
| 6,783,405 | B1 | 8/2004 | Yen | |
| 7,121,340 | B2 | 10/2006 | Grove et al. | |
| 7,197,985 | B2 | 4/2007 | Markel et al. | |
| 8,286,697 | B2 | 10/2012 | Evans et al. | |
| 8,347,963 | B2 | 1/2013 | Johnson et al. | |
| 8,555,764 | B2 | 10/2013 | Le et al. | |
| 8,939,802 | B2 | 1/2015 | Hara et al. | |
| 9,523,265 | B2 | 12/2016 | Upchurch et al. | |
| 9,598,941 | B1 * | 3/2017 | Upchurch | F42C 19/08 |
| 9,605,937 | B2 | 3/2017 | Eitschberger et al. | |
| 10,507,433 | B2 | 12/2019 | Eitschberger et al. | |
| 10,669,821 | B2 | 6/2020 | Knight et al. | |
| 11,078,761 | B2 | 8/2021 | Grove et al. | |
| 11,098,563 | B1 | 8/2021 | Ludwig | |
| 11,299,967 | B2 | 4/2022 | Bradley et al. | |
| 11,313,208 | B2 * | 4/2022 | Hoelscher | E21B 43/1185 |
| 11,359,468 | B2 | 6/2022 | Roberts et al. | |
| 11,547,976 | B2 | 1/2023 | Ledwon et al. | |
| 11,608,720 | B2 | 3/2023 | Preiss et al. | |
| 11,674,370 | B2 | 6/2023 | Shelton et al. | |
| 2003/0047313 | A1 | 3/2003 | Wehunt, Jr. | |
| 2004/0216633 | A1 | 11/2004 | Kash | |
| 2004/0216866 | A1 | 11/2004 | Barlow et al. | |
| 2007/0084336 | A1 | 4/2007 | Neves | |
| 2007/0107589 | A1 | 5/2007 | Rospek et al. | |
| 2007/0119327 | A1 | 5/2007 | Myers, Jr. et al. | |
| 2010/0227514 | A1 | 9/2010 | Rikimaru et al. | |
| 2011/0042089 | A1 | 2/2011 | Chang et al. | |
| 2011/0127045 | A1 | 6/2011 | Spence et al. | |
| 2014/0065351 | A1 | 3/2014 | Cordner et al. | |
| 2014/0260591 | A1 | 9/2014 | Rodgers et al. | |
| 2014/0262503 | A1 | 9/2014 | Rodgers et al. | |
| 2016/0376879 | A1 * | 12/2016 | Goodman | E21B 43/11855 175/4.57 |
| 2017/0145798 | A1 | 5/2017 | Robey et al. | |
| 2017/0275974 | A1 | 9/2017 | Von Kaenel et al. | |
| 2018/0112500 | A1 * | 4/2018 | Collins | E21B 43/117 |
| 2018/0195372 | A1 | 7/2018 | Robey et al. | |
| 2020/0024935 | A1 | 1/2020 | Eitschberger et al. | |
| 2020/0048996 | A1 * | 2/2020 | Anthony | E21B 43/119 |
| 2020/0072029 | A1 * | 3/2020 | Anthony | E21B 43/117 |
| 2020/0200516 | A1 | 6/2020 | Zemla et al. | |
| 2020/0248535 | A1 | 8/2020 | Goyeneche | |
| 2020/0256166 | A1 | 8/2020 | Knight et al. | |
| 2020/0392819 | A1 | 12/2020 | Robey et al. | |
| 2021/0172298 | A1 | 6/2021 | Knight et al. | |
| 2021/0189846 | A1 * | 6/2021 | Bradley | E21B 43/117 |
| 2021/0222525 | A1 | 7/2021 | Dyess et al. | |
| 2021/0277752 | A1 | 9/2021 | Eitschberger | |
| 2021/0332678 | A1 * | 10/2021 | Anthony | E21B 43/119 |
| 2021/0355798 | A1 * | 11/2021 | Hoelscher | E21B 43/1185 |
| 2021/0396103 | A1 | 12/2021 | MacGillivray et al. | |
| 2022/0010660 | A1 * | 1/2022 | Dyess | E21B 17/028 |
| 2022/0018226 | A1 * | 1/2022 | Wells | E21B 47/04 |
| 2022/0018227 | A1 * | 1/2022 | Kash | E21B 43/117 |
| 2022/0099423 | A1 * | 3/2022 | Sullivan | F42B 3/10 |
| 2022/0127935 | A1 | 4/2022 | Grove et al. | |
| 2022/0145732 | A1 * | 5/2022 | Anthony | E21B 43/119 |
| 2022/0282600 | A1 * | 9/2022 | Dyess | E21B 43/1185 |
| 2023/0069950 | A1 * | 3/2023 | Badii | E21B 43/1185 |
| 2023/0184066 | A1 | 6/2023 | Hoelscher et al. | |

FOREIGN PATENT DOCUMENTS

| | | | |
|---|---|---|---|
| DE | 102021108869 | A1 | 11/2021 |
| WO | 2016118179 | A1 | 7/2016 |
| WO | 2021198145 | A1 | 10/2021 |
| WO | 2022184731 | A1 | 9/2022 |

OTHER PUBLICATIONS

Halliburton. Velocity™ Aligned Gun System. Halliburton, 2023. H014094 Feb. 2023. PDF file. 2 pages.

Halliburton. Velocity™ Revolve Gun System. Halliburton, 2023. H014095 Feb. 2023. PDF file. 2 pages.

International Search Report and Written Opinion for International Patent Application No. PCT/US2023/083902 dated Apr. 18, 2024. PDF file. 10 pages.

International Search Report and Written Opinion for International Patent Application No. PCT/US2023/032050 dated Dec. 28, 2023. PDF file. 10 pages.

Halliburton, Velocity Perforating System, H012844WP, Mar. 2021.

International Search Report and Written Opinion for International Patent Application No. PCT/US2023/080589 dated Mar. 19, 2024. PDF file. 10 pages.

International Search Report and Written Opinion for International Patent Application No. PCT/US2023/080587 dated Mar. 19, 2024. PDF file. 8 pages.

* cited by examiner

DETONATING CORD DEPTH LOCATING FEATURE

CROSS-REFERENCE TO RELATED APPLICATIONS

The present application is a non-provisional application claiming priority to U.S. Provisional Patent Application No. 63/409,701 filed Sep. 23, 2022, the entire disclosure of which is incorporated herein by reference.

BACKGROUND

Wells are often drilled to extract hydrocarbons, such as oil and gas. After drilling a wellbore that traverses a hydrocarbon-bearing formation, a casing string is installed to reinforce portions of the wellbore. A casing string comprises large diameter metal tubulars that are connected end to end, lowered into the wellbore, and cemented in place. The casing string increases the integrity of the wellbore and provides a structure for supporting other wellbore equipment such as production tubing used for producing fluids from one or production zones of the formation to surface. When a production zone is lined with casing, the casing must be perforated in order for formation fluids to enter the wellbore. These perforations are hydraulic openings that extend through the casing and into the surrounding formation.

Typically, perforations are created by lowering a perforating gun string downhole and detonating a series of explosive shaped charges adjacent to the production zone. For safety, perforating guns may be transported to a wellsite in a partially unassembled state to prevent accidental detonation. Once fully assembled at the wellsite, a perforating gun string may be lowered into the cased wellbore on an appropriate conveyance, such as a wireline. An explosive train is then initiated to detonate the shaped charges in a predetermined fashion. The perforating gun string may then be retrieved to the surface.

BRIEF DESCRIPTION OF THE DRAWINGS

These drawings illustrate certain aspects of some of the embodiments of the present disclosure and should not be used to limit or define the method.

DETAILED DESCRIPTION

This disclosure is directed to downhole operations and, more particularly, embodiments are directed to well perforating. In accordance with present embodiments, a perforating gun includes a detonating cord depth locating feature for optimal side-by-side detonation. When assembling a perforating gun, it is important to make proper connections between components of the explosive train to ensure the perforating gun will operate properly. An important aspect of that assembly is being able to properly route and connect the detonating cord, which is integral to the explosive train. For example, in a side-by-side type detonator such as in the examples discussed below, the detonating cord overlaps a portion of the detonator. Controlling the amount of that overlap and making sure the detonating cord is properly positioned ensures reliable detonation. Aspects of the disclosure may be embodied in an any of a variety of apparatus, systems, and/or methods directed to limiting an insertion depth of the detonating cord, thereby ensuring, and maintaining the correct length of this overlap for side-by-side detonation.

In one aspect, a detonator housing is disclosed for receiving and interconnecting various components of a detonator such as the detonator and detonating cord. The detonator housing is optionally molded as a unitary structure comprising various features that position and secure the detonator components in a desired spatial relationship to ensure reliable detonation. The detonator housing includes, for example, a detonator receptacle for receiving a portion of the detonator and a detonating cord receptacle for receiving a portion of the detonating cord in an overlapping (side-by-side) relationship to the detonator. The detonating cord receptacle may include any of a variety of features to help position the detonating cord in relation to the detonator, such as to achieve the intended amount of overlap and without inserting the detonating cord too far. These and a variety of other features discussed below and illustrated in the accompanying figures allow for enhanced side-by-side detonation of the detonating cord to detonator.

Figure 1:
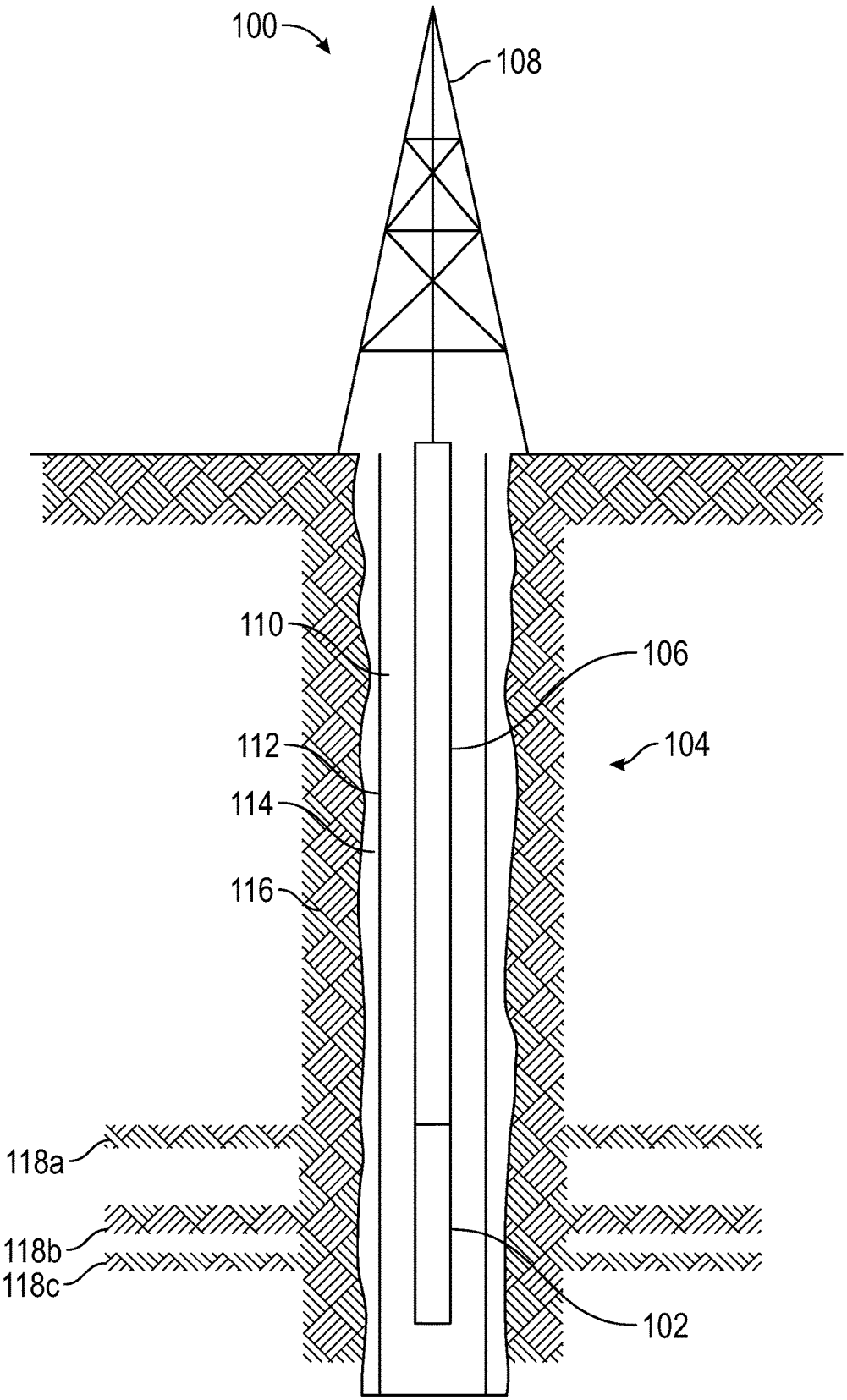
FIG. 1 is a system showing a perforating tool assembly in a wellbore during a land-based operation, in accordance with one or more embodiments of the present disclosure. %

FIG. 1 is a system 100 showing a perforating tool assembly 102 in a wellbore 110 during a land-based operation. The system 100 comprises a servicing rig 108 disposed on a terrestrial surface over a wellbore 110 extending into subterranean formation 116. Wellbore 110 may be vertical, deviated, horizontal, and/or curved at one or more regions of subterranean formation 116. Wellbore 110 may be cased, open hole, contain tubing, and may generally comprise a hole in the ground, i.e., "borehole", extending any appropriate distance into subterranean formation 116. In one or more examples, one or more regions of the wellbore 110 may be secured at least in part by cement 114.

Servicing rig 100 may be a drilling rig, completion rig, workover rig, or other mast structure supporting work string 104. In some examples, servicing rig 100 comprises a derrick and rig floor through which work string 104 extends downwards into wellbore 110. As will be shown in FIG. 2, a wellbore may be alternatively positioned in a sea-based environment, such as on a semi-submersible platform or rig, or otherwise disposed above a sea floor at an off-shore location.

As illustrated, work string 104 may comprise a conveyance 106 and a perforating tool assembly 102, i.e., "perforating gun string", comprising one or more perforating guns. In addition, work string 104 may comprise other downhole tools, such as one or more packers, one or more completion components, e.g., screens and/or production valves, one or more sensing components and/or measuring equipment, i.e., downhole sensors, and other equipment not shown in FIG. 1. In operation, work string 104 is lowered into wellbore 110 and one or more explosive charges disposed within the one or more perforating guns are detonated to perforate casing 112 to facilitate fluidic communication between one or more production zones ("pay zones") 118*a*, 118*b*, 118*c*, and wellbore 110.

As will be shown in later figures, i.e., FIGS. 4 and 7, perforating tool assembly 102 may comprise a single or a plurality of perforating guns, which may be coupled together. While the present figures generally show a single, or a few perforating guns, it should be understood that perforating tool assembly 102 may comprise any suitable number of perforating guns. In one or more examples, the perforating tool assembly 102 may further comprise a firing head for initiating a detonation train to fire each of the perforating guns. In addition, the perforating tool assembly 102 may further comprise tandems, spacers, or other coupling structures for coupling together the perforating guns.

Figure 2:
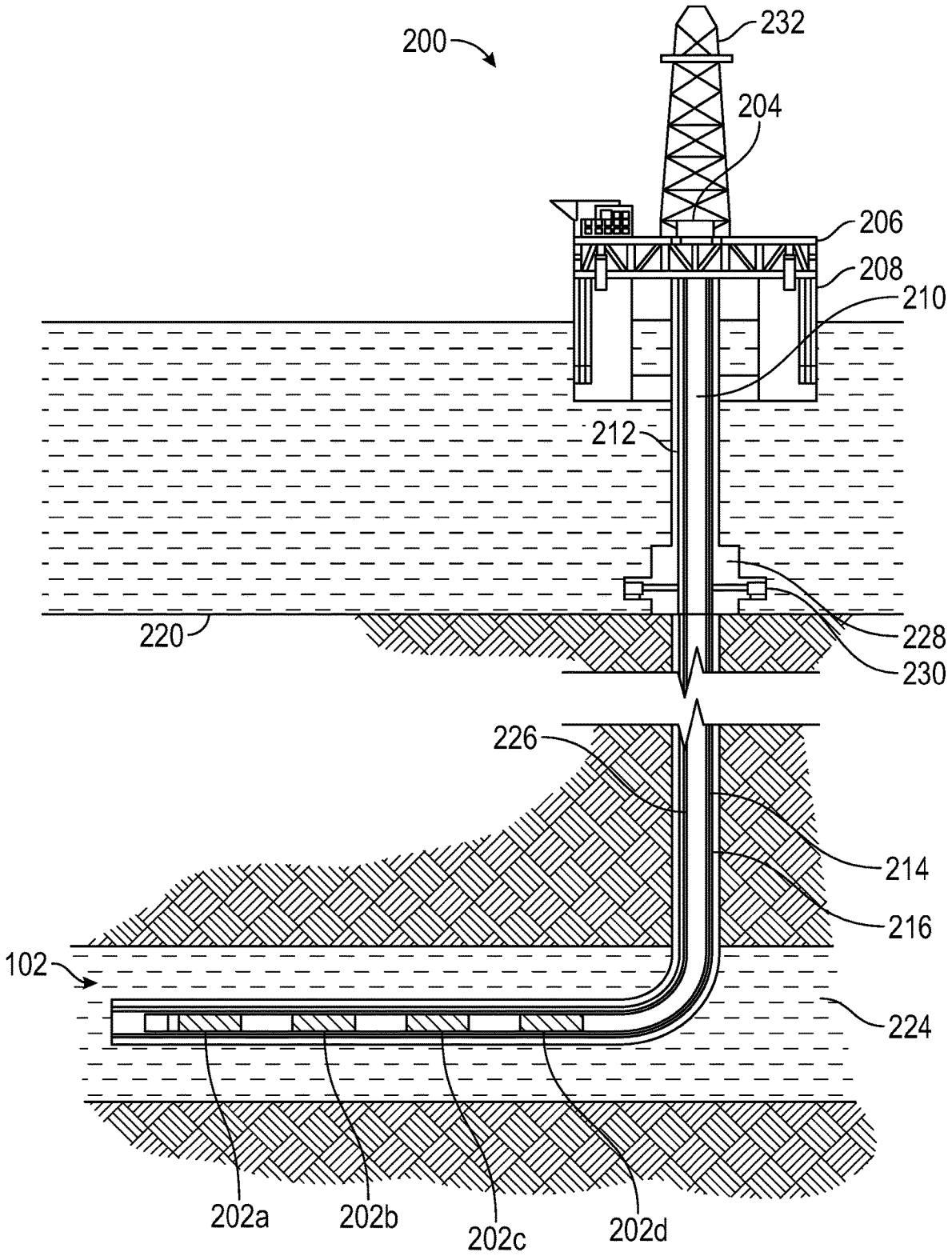
FIG. 2 is a system showing a perforating tool assembly in a wellbore during a sea-based operation, in accordance with one or more embodiments of the present disclosure.

FIG. 2 is a system 200 showing a perforating gun assembly 102 comprising one or more perforating guns 202*a*, 202*b*, 202*c*, and 202*d* in a wellbore 214 during a sea-based operation, in accordance with one or more embodiments of the present disclosure. As mentioned, the principles shown and described with respect to perforating during land-based operations are equally applicable to sea-based operations.

As illustrated, a wellbore 214 may extend into a subterranean formation 224 beneath a sea floor 220. A semi-submersible platform 206 is centered over a hydrocarbon-bearing formation 224 located beneath a sea floor 220. A subsea conduit 212 extends from deck 208 of platform 206 to wellhead installation 228 which may include one or more subsea blow-out preventers 230. Platform 206 has a hoisting apparatus 204 and a derrick 232 for raising and lowering tubular strings such as work string 210.

Figure 3:
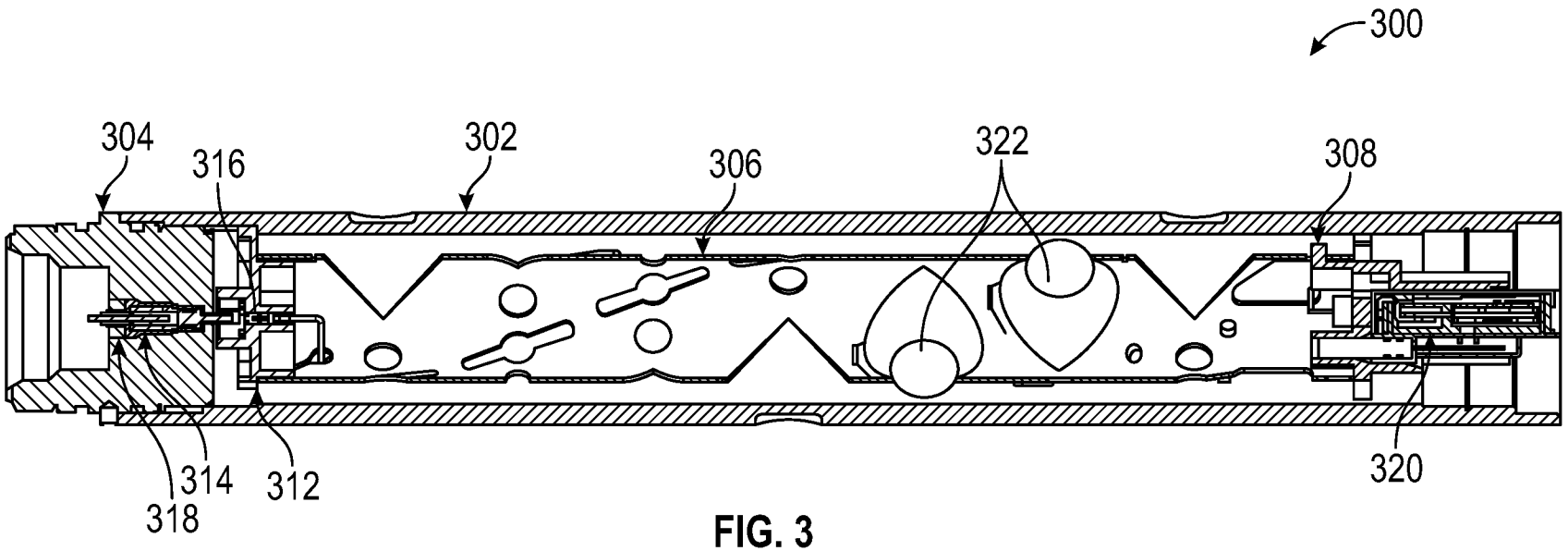
FIG. 3 is a single perforating gun in accordance with one or more embodiments of the present disclosure.

A wellbore 214 extends through various earth strata including subterranean formation 224. Casing 226 is cemented within wellbore 214 by cement 216. Work string 210 may be substantially identical to work string 104 (e.g., referring to FIG. 1), except that it is adapted for a subsea environment. In operation, work string 210 is similarly lowered through casing 226 until one or more perforating guns of work string 210 reach a desired depth. Thereafter, the explosive charges are detonated to perforate casing 226. In either of FIG. 1 or 2, detonation may occur in either a down-going (downhole) or an up-going (uphole) fashion. As shown, work string 210 comprises one or more perforating guns 202*a*, 202*b*, 202*c*, 202*b* which may be joined together during, for example, tubular make-up of the gun string. FIGS. 3 and 4 further show, with more detail, the individual perforating gun(s) 300.

FIG. 3 is a side view of a single perforating gun 300 in accordance with one or more embodiments of the present disclosure. The perforating gun 300 may be one of a plurality of perforating guns connected end to end to achieve a perforating gun assembly 102 (e.g., referring to FIG. 1, 2). The perforating gun 300 includes a gun body 302 that contains a bulkhead 304, a charge tube 306, and a detonator housing 308, which houses a detonator 320. The gun body 302 is a generally tubular body, in this example, in which the other gun components are disposed. As illustrated, a plurality of perforating charges are secured to the charge tube 306 at different positions and firing orientations along the charge tube 306. The charge tube 306 has a generally continuous tubular construction in this example. However, all other suitable charge tube configurations are also within the scope of this disclosure, such as modular charge tubes formed by snapping together or otherwise interconnecting any number of charge tube segments that each hold one or more perforating charges within a perforating gun. A detonator housing 308 according to this disclosure is coupled to the charge tube 306 at one end. The detonator housing 308 includes various features facilitating assembly including for securing a detonator 320, detonating cord, and other components, as further discussed below, and illustrated in subsequent figures. On the opposite end of the charge tube 306 from the detonator housing 308, the bulkhead 304 is secured to the charge tube 306.

Figure 4:
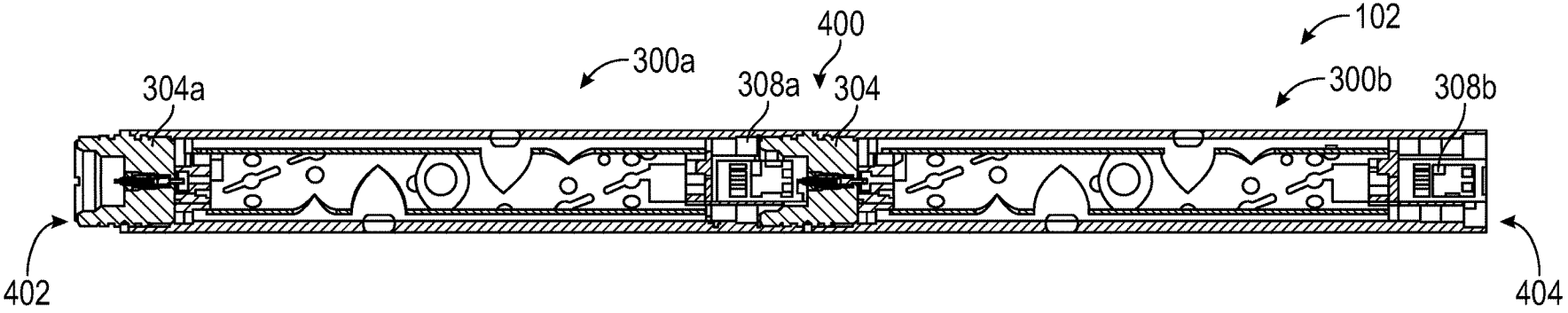
FIG. 4 shows a tubular string with two perforating guns coupled together, in accordance with one or more embodiments of the present disclosure.

FIG. 4 shows a tubular string with two perforating guns 300*a* and 300*b* coupled together at an interface 400, in accordance with one or more embodiments of the present disclosure. A first perforating gun 300*a* may be coupled to a perforating gun 300*b* end to end, as illustrated. An uphole side 402 and downhole side 404 of a perforating gun assembly 102 comprising two perforating guns 300*a*, 300*b* are shown. At least a portion of detonator housing 308*a* corresponding to the first perforating gun 300*a* may be disposed within a bulkhead 304*b* corresponding to the second perforating gun 300*b*. Coupling of a first perforating gun 300*a* to a second perforating gun 300*b* in this manner allows for reliable transmission of an initial ignition to propagate along one or more detonation cords traversing the length of a detonation train and serial detonation of each perforating gun of the detonation train.

Figure 5:
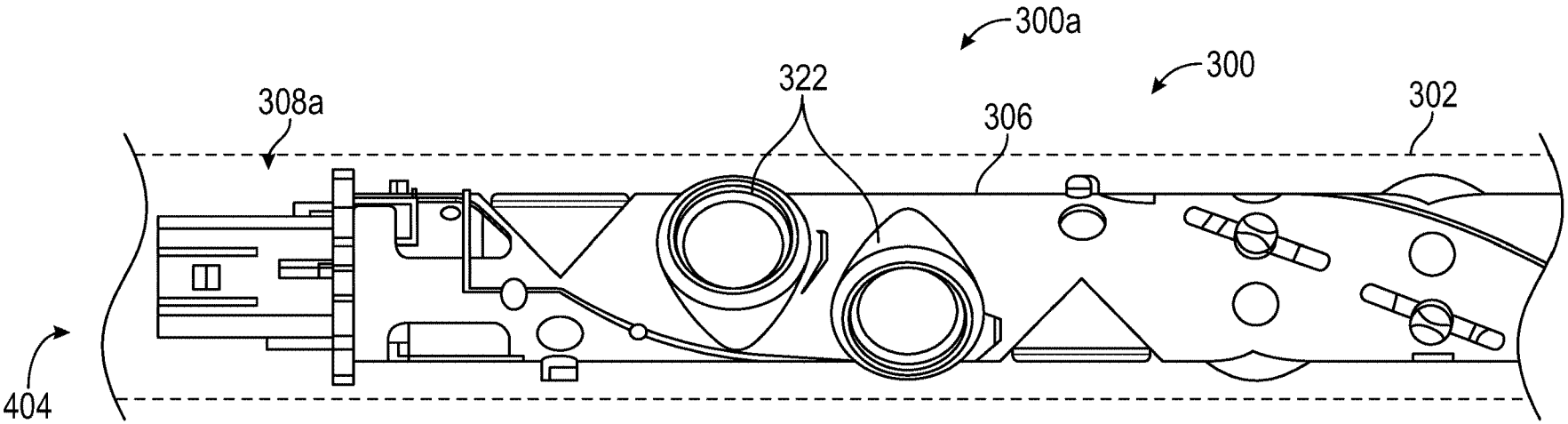
FIG. 5 is a side view of a detonator end of a perforating gun in accordance with one or more embodiments of the present disclosure.

FIG. 5 is a side view of downhole side 404 (e.g., referring to FIG. 4) of a perforating gun 300 according to an example configuration that may incorporate aspects of this disclosure. FIG. 5 is substantially similar to FIG. 3, except that perforating gun 300 is flipped around from left-to-right, and only the downhole side 404 of perforating gun 300 having detonator housing 308 is shown. At least a portion of the detonator housing 308*a* of a first perforating gun 300*a* may be seated within a bulkhead 304*b* (e.g., referring to FIG. 4) of a neighboring perforating gun 300*a* at the interface 400, however, the bulkhead 304*a* is omitted in FIG. 5 for reference to more clearly show the detonator housing 308*a*. The charge tube 306 and components assembled thereon may be positioned inside a protective gun body schematically indicated at 302 for lowering the perforating gun 300 or gun string into a wellbore on a wireline or other conveyance.

Figure 6:
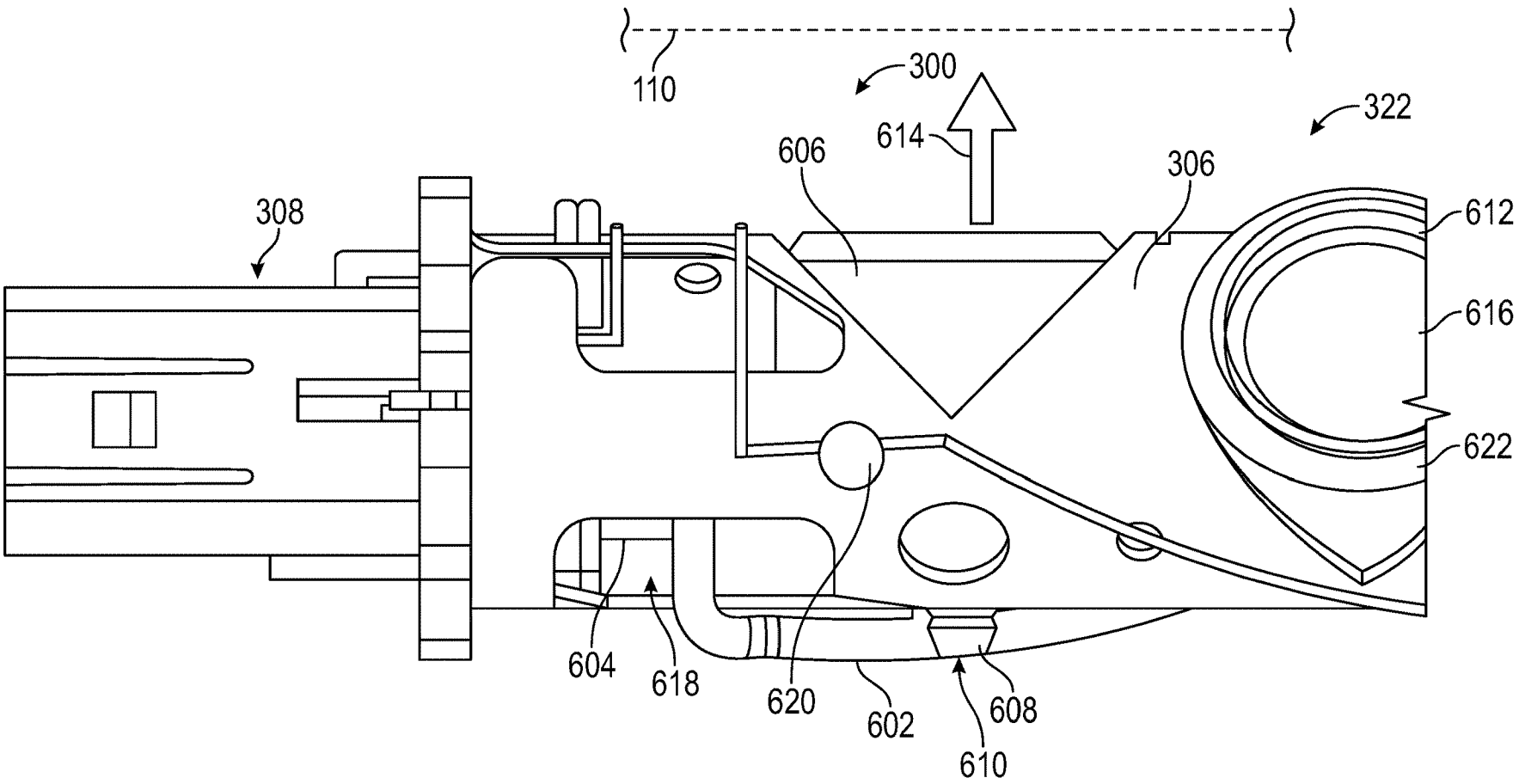
FIG. 6 is an enlarged side view of the detonator end of a perforating gun after a detonating cord has been installed and inserted into the detonator housing in accordance with one or more embodiments of the present disclosure.

FIG. 6 is an expanded side view of the perforating gun 300 after a detonating cord 602 has been installed and inserted into the detonator housing 308. The detonating cord 602 may be arranged along the charge tube 306, such as by wrapping the detonating cord 602 around the charge tube 306 in a generally helical fashion and connecting the detonating cord 602 to each perforating section 606. Each perforating section 606 may include a charge case 622 containing an explosive charge for forming perforations in a borehole wall 120 (e.g., referring to FIG. 1) and an explosive booster 608 at an initiation end 610. The explosive charge may be disposed within the charge case 622, for example, below the area indicated for a projectile (e.g., invertible metal conical liner) at 616 prior to lowering of the perforating gun assembly 102 (e.g., referring to FIGS. 1, 2, and 4). The explosive charge may be referred to as a "shaped charge" by virtue of a concave interior shape 612 of the charge case 606 that helps focus the explosive energy in a firing direction 614 directed toward the borehole wall 120. In one or more examples, the explosive charge may be configured to invert and launch a projectile 616 through casing 110 and into the formation 116 (e.g., referring to FIG. 1). The detonating cord 602 may be laterally attached to each perforating charge at the initiation end 610 in a configuration for passing the explosive detonation from the detonating cord 602 to the booster 608 and to the shaped explosive within the charge case 606. An end portion 604 of the detonating cord 602 is inserted through a window 618 on the charge tube 306 and secured to the detonator housing 308. The window 618 is also one of a variety of features that facilitate visually confirming insertion of the detonating cord 602 at an appropriate insertion distance into the charger carrier 306. Also visible in this figure is a wire fastener 620 which, in some examples, may secure one or more signal conductors to its appropriate orientation along the charge case 306.

Figure 7:
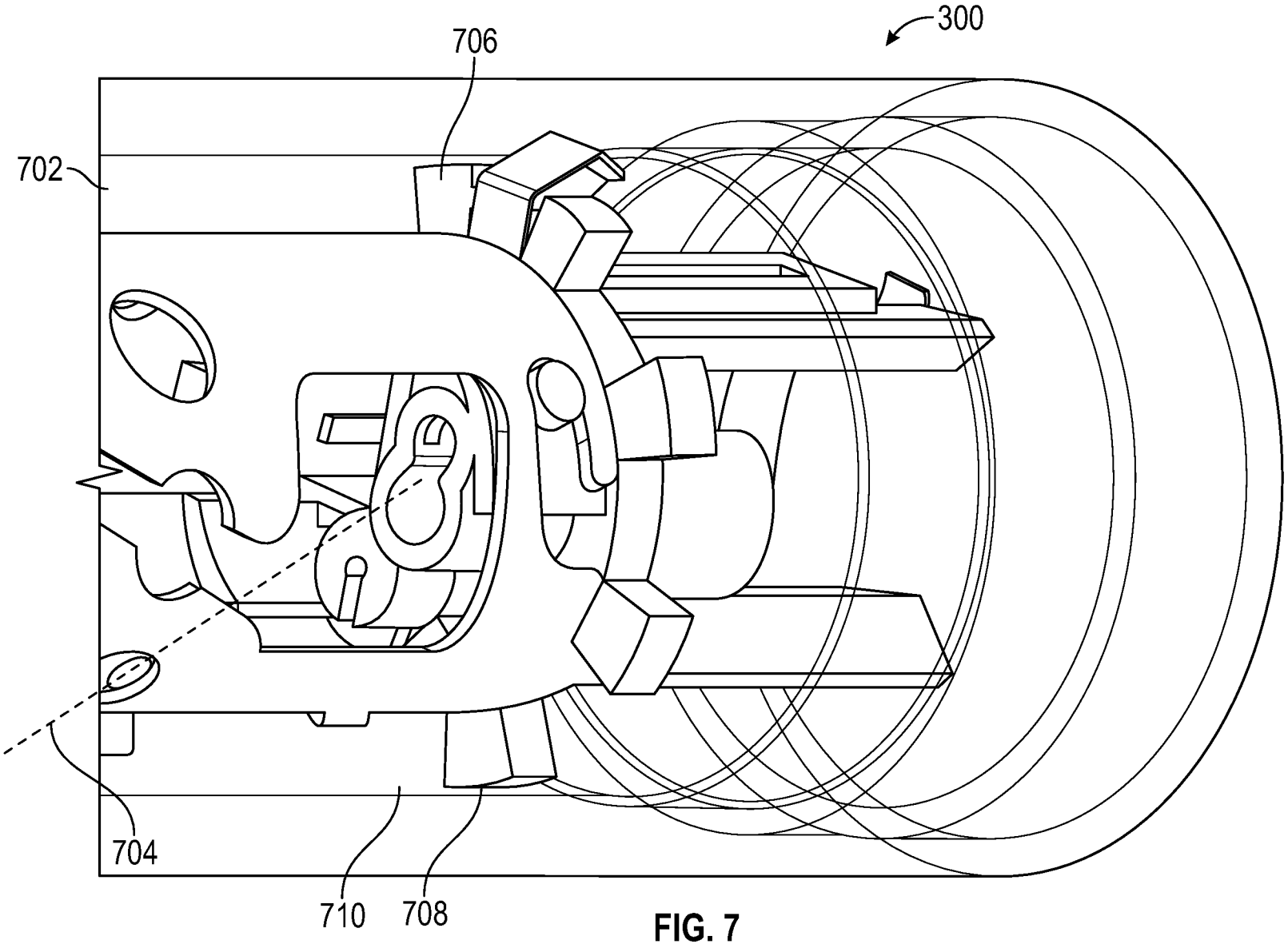
FIG. 7 is a perspective view of the perforating gun illustrating a first line of sight that may allow for visually confirming insertion of the detonating cord of FIG. 6, in accordance with one or more embodiments of the present disclosure.

FIG. 7 is a semi-transparent side view of the perforating gun 300 illustrating a first line of sight 700 that may allow for visually confirming insertion of the detonating cord 602 of FIG. 6 at the appropriate insertion distance, in accordance with one or more embodiments of the present disclosure. The first line of sight 704 is looking toward the detonator housing 308, through the window 618 (e.g., referring to FIG. 6), from a proximate end 702 of the detonator housing 308. In this view, a detonator cord receptacle 708 and a detonator receptacle 710 can be seen for receiving a respective detonator cord and detonator to be discussed in greater detail later.

These and other detonator components and assembly steps may be performed at least in part at a manufacturing facility, to reduce the number of steps to be completed in the field. Certain assembly steps, such as installing a detonator and making certain connections as part of the explosive train, may be deferred until the perforating gun 300 reaches the field, where the perforating gun 300 will be finally assembled and used. Deferring these steps helps avoid accidental detonation of the perforating charges during transportation to the field. The actual order of assembly may vary due to the variety of different products that may incorporate these features, and the different markets, well sites, and so forth that will use the perforating gun 300. Regardless of location of assembly in the manufacturing facility or in the field, the assembler in the manufacturing facility, in the field, or wherever detonator components are installed will benefit from features that facilitate assembly. For example, features of the detonator housing 308 further disclosed below will help the assembler insert the end portion 604 of the detonating cord 602 to the proper depth and ensure the detonating cord 602 is fully and securely seated in the detonator housing 308.

Figure 8:
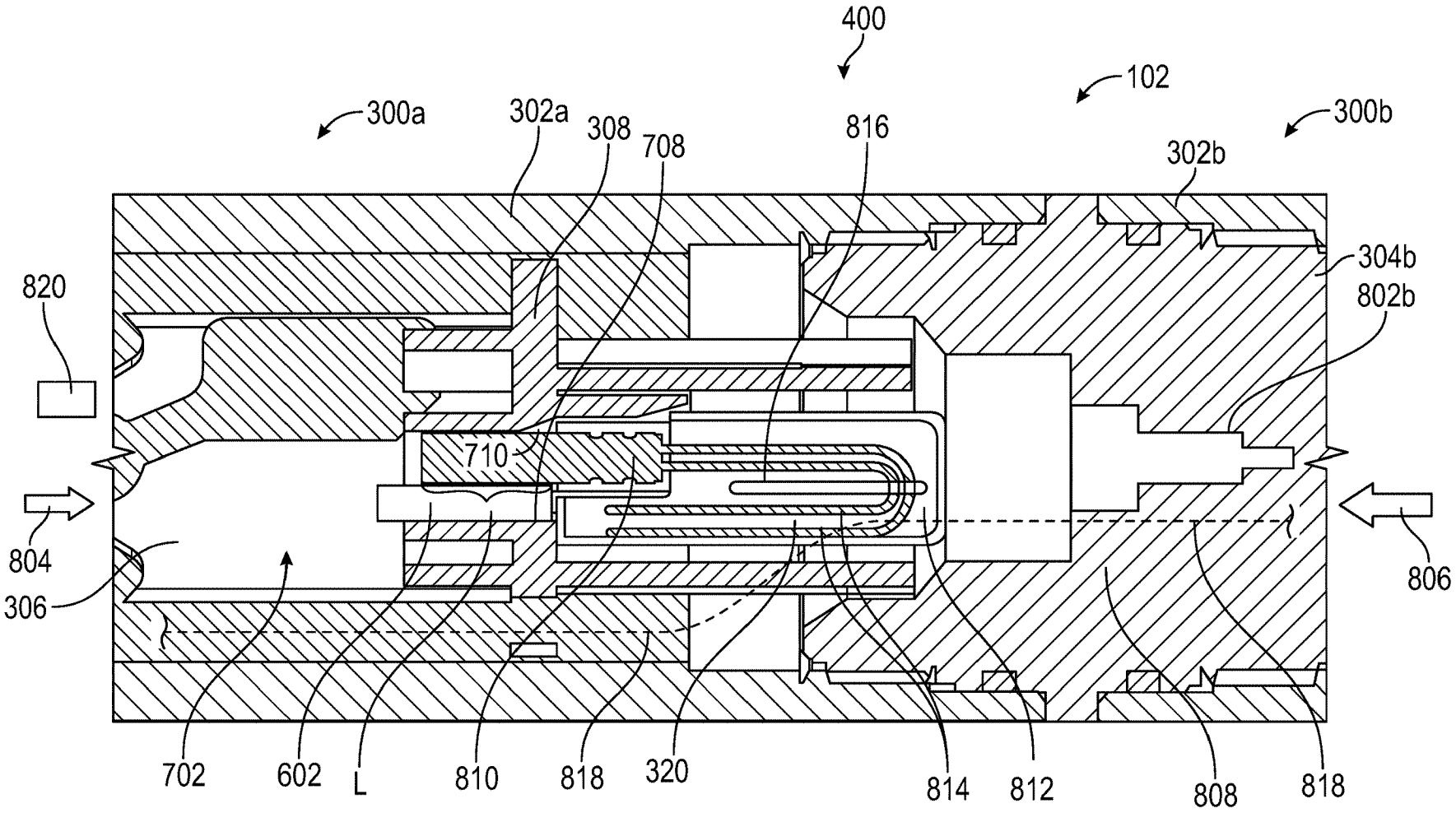
FIG. 8 is sectional side view of a perforating gun of FIG. 4, coupled end to end with a second perforating gun as part of a perforating gun string in accordance with one or more embodiments of the present disclosure.

FIG. 8 is a sectional side view of the perforating gun 300*a* of FIGS. 3 and 4, coupled end to end at the interface 400 (e.g., referring to FIG. 4) with a second perforating gun 300*b* as part of a perforating gun string, i.e., perforating gun assembly 102 (e.g., referring to FIG. 1) in accordance with one or more embodiments. The two perforating guns 300*a* and 300*b* are interconnected at their respective gun bodies 302*a*, 302*b* at the interface 400 by any suitable connection type, e.g., threaded connections, set screws, and the like. A bulkhead 304*b* of perforating gun 300*b* provides a physical barrier between the internal cavities of adjacent perforating gun bodies while providing electrical pathways therethrough. This may allow, in some examples, the perforating gun assembly 102 to quickly relay the detonation signal to the next gun while still maintaining good separation between the potentially high-pressure environments of the perforating guns 300*a*, 300*b* during detonation. Any number of additional perforating guns (not shown) may also be added to the perforating gun assembly 102.

In operation according to one or more examples, a detonation signal is relayed from a source (e.g., uphole electronics) down to the detonator 320*a*. From the detonator 320*a*, the detonation signal may proceed downhole to the next perforating gun 300*b* through the electrical feedthrough 802*b* while detonating the explosive charges of the first perforating gun 300*a* in an up-going fashion. It should be understood that while detonating of the various perforating guns of the perforating gun assembly 102 (e.g., referring to FIGS. 1, 2, 4) may occur in a generally down-going fashion, detonation of the explosive charges of each perforating gun 300*a*, 300*b* may occur in an up-going fashion, as illustrated in the present example. Use in this manner may, in some examples, prevent a situation where the actual detonation outpaces the detonation signal, which would potentially interfere with signal transmission from gun to gun along the perforating gun assembly. This may ensure reliable detonation in some examples.

With continued reference to FIG. 8, the perforating gun 300*b* has been further assembled by inserting the detonating cord 602 in one insertion direction 804 from a proximal end 702 of the detonator housing 308 and inserting the detonator 320*a* in an opposing insertion direction 806 from a distal end 808 of the detonator housing 308. The detonator receptacle 710 and cord receptacle 708 are thus oppositely facing to receive the detonator 320 and detonating cord 602 from the opposing insertion directions 804, 806. The end portion 604 of the detonating cord 602 is received within a detonating cord receptacle 708 on the proximal end 702. A portion of the detonator 320 referred to as the explosive initiator 810 is received by a detonator receptacle 710 on the distal end 808 of the detonator housing 308. The explosive initiator 810 may comprise an explosive material inside a shell, wherein the shell is configured to fit closely within the detonator receptacle 710. With the detonating cord 602 fully seated within the detonating cord receptacle 708, and with the explosive initiator 810 of the detonator 320 fully seated within the detonator receptacle 710, the detonating cord 602 and explosive initiator 810 of the detonator 320 overlap by a desired overlap length "L", i.e., the detonating cord 602 and detonator 320 are in a side-by-side arrangement along this length L. The length "L" may be, for example, between 0.1 millimeters and 5 centimeters, or any ranges therebetween. The length "L" is of sufficient length to provide sufficient overlap between detonating cord 602 and detonator 320 to perform side by side detonation.

The detonator 320 is a part of the explosive train used to trigger an explosion of the perforating charges. The detonator 320 may generally comprise the explosive initiator 810, a body 812, one or more wires 814, and optionally, a wire clip 816. The detonator 320 may energize the detonating cord 602 to detonate the explosive charges upon receiving a detonation signal transmitted downhole to wires 814. For example, the detonation signal may be transmitted down a wireline schematically indicated at 820 to the perforating gun 300*b* from the surface of a wellsite. The explosive initiator 810 of the detonator 320 received into the detonator receptacle 710 may include a small amount of explosive material responsive to the electric signal. The explosive material may comprise a primary explosive and a secondary explosive. The primary explosive may be extremely sensitive to stimuli, such as an electrical signal in this case. The secondary explosive is typically a larger quantity of less sensitive explosive material that is triggered by the primary explosive. Any suitable explosive material can be used, as a variety of explosive materials for use in detonators are generally available. The overlap L ensures reliable transfer of detonation energy from the detonator 320 to the detonating cord 602. The detonating cord receptacle 708 also limits insertion as further discussed below to prevent further insertion of the detonating cord 602. Even without being able to see the end portion 604 of the detonating cord 602, the assembler can push the detonating cord 602 as far as it will go until it is fully seated, and thus be assured that the detonating cord 602 has been inserted to the intended depth and associated overlap L. Also, while not shown, one or more conductive surfaces of the detonator 320 may be grounded to one or more other components of the perforating gun assembly 102 (e.g., referring to FIG. 1), such as to the charge tube 306, the bulkhead 304*b*, gun body 302*a*, gun body 302*b*, or any combination thereof. Such grounding may mitigate detonating failure by preventing charge build-up of one or more regions of the detonator 320.

Thus, when the perforating gun assembly 102 is assembled, the string of shaped charges is electrically connected inside the perforating gun body 302*b* with the common detonating cord 602 used to explosively detonate the shaped charges in response to a detonation signal. The detonating cord 602 is connected to the detonator 320 housed in the perforating gun body 302*b*. The detonator 320 may energize the detonating cord 602 to detonate the explosive charges within the respective perforating gun body 302 upon receiving the detonation signal. A separate signal conductor schematically indicated at 818 is formed through each perforating gun body 302*a*, 302*b*. The signal conductors 818 may comprise, for example, a flexible wire, an electric trace, or a ribbon, that is routed along each perforating gun body 302*a*, 302*b* to a signal input on each detonator 320. In one or more examples, the signal conductors 818 may be wrapped helically around the charge tube 306. The signal conductors 818 are interconnected via the connection between each pair of adjacent perforating guns to form a continuous signal path for communicating electrical signals from the wireline 820, along the perforating gun assembly 102, and to each detonator 320. The location of the detonator 320, and the routing of the detonating cord 602 and signal conductors 818 within each perforating gun body 302*a*, 302*b*, are illustrated by way of example and may vary according to the design of the perforating gun selected.

Figure 9:
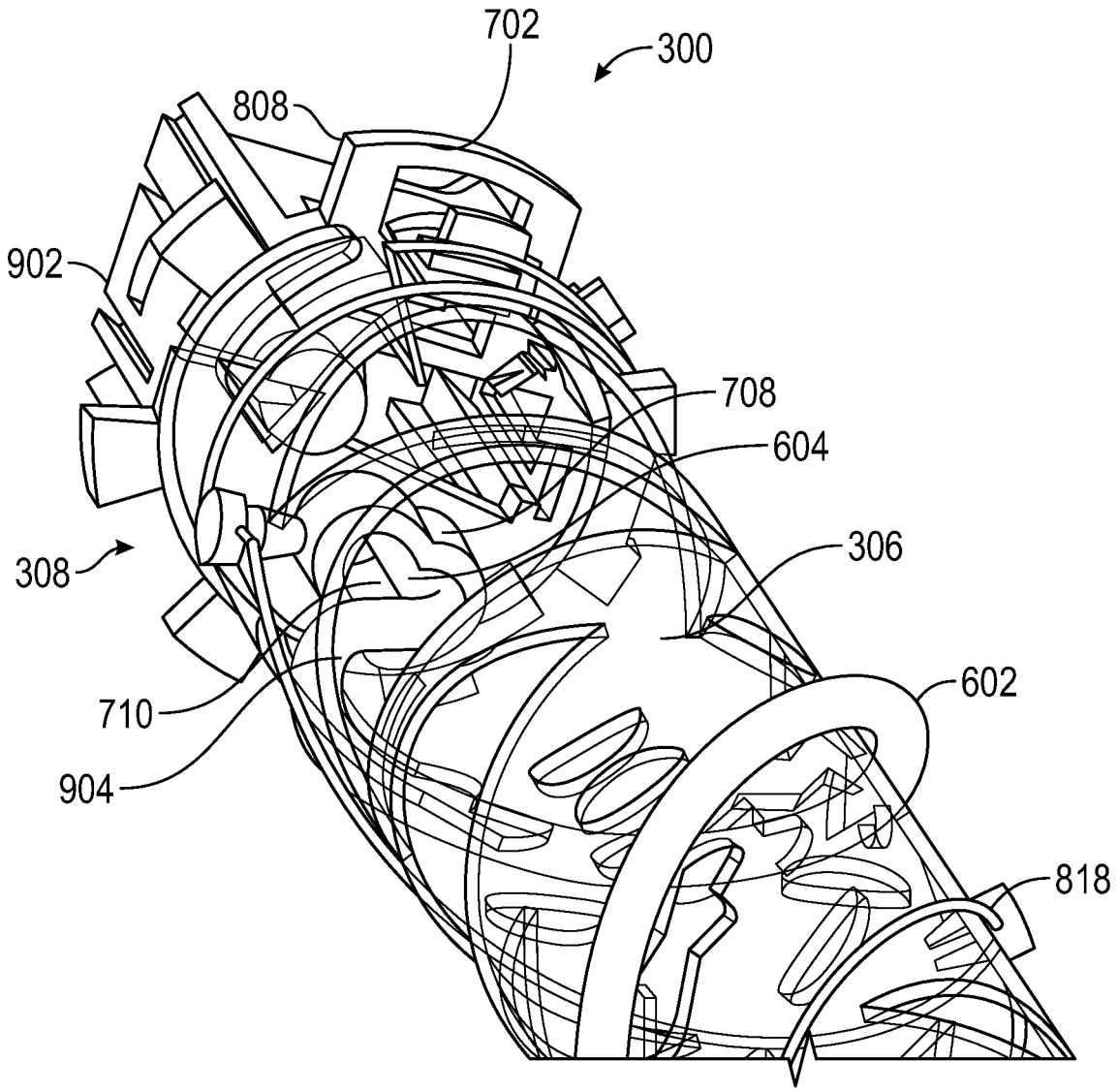
FIG. 9 is a perspective view of the perforating gun rotated away from the orientation of FIG. 5, in accordance with one or more embodiments of the present disclosure.

FIG. 9 is a semi-transparent perspective view of a perforating gun 300 rotated away from the orientation of FIG. 8 to show various features from another angle. It can be seen, for example, how the detonating cord 602 is wrapped in an optionally helical arrangement about the charge tube 306 and how the end portion 604 of the detonating cord 602 enters the detonating cord receptacle 708. The detonator (e.g., detonator 320 on FIG. 8) is omitted for reference in this view so that the detonator receptacle 710 is shown unoccupied. This view provides another perspective of how the detonating cord receptacle 708 is generally aligned with the detonator receptacle 710 in a parallel, side-by-side arrangement. Also visible is the detonator housing 308, signal conductor 818 (e.g., wire) wrapped helically around the charge tube 306, a male end 902 of a "click-lock" fastener, as well as the proximate end 702 of the detonator housing 308. The distal end 808 would be visible when viewed from behind the detonator housing 308 relative to the perspective shown in the figure. Also, as illustrated, the detonating cord 602 may be wrapped around the charge tube 306, except for where it enters through an aperture of the charge tube 306 at the bend 904 so that it may be routed from without the charge tube 306 to within the charge tube 306 and to the detonating cord receptacle 708.

Figure 10:
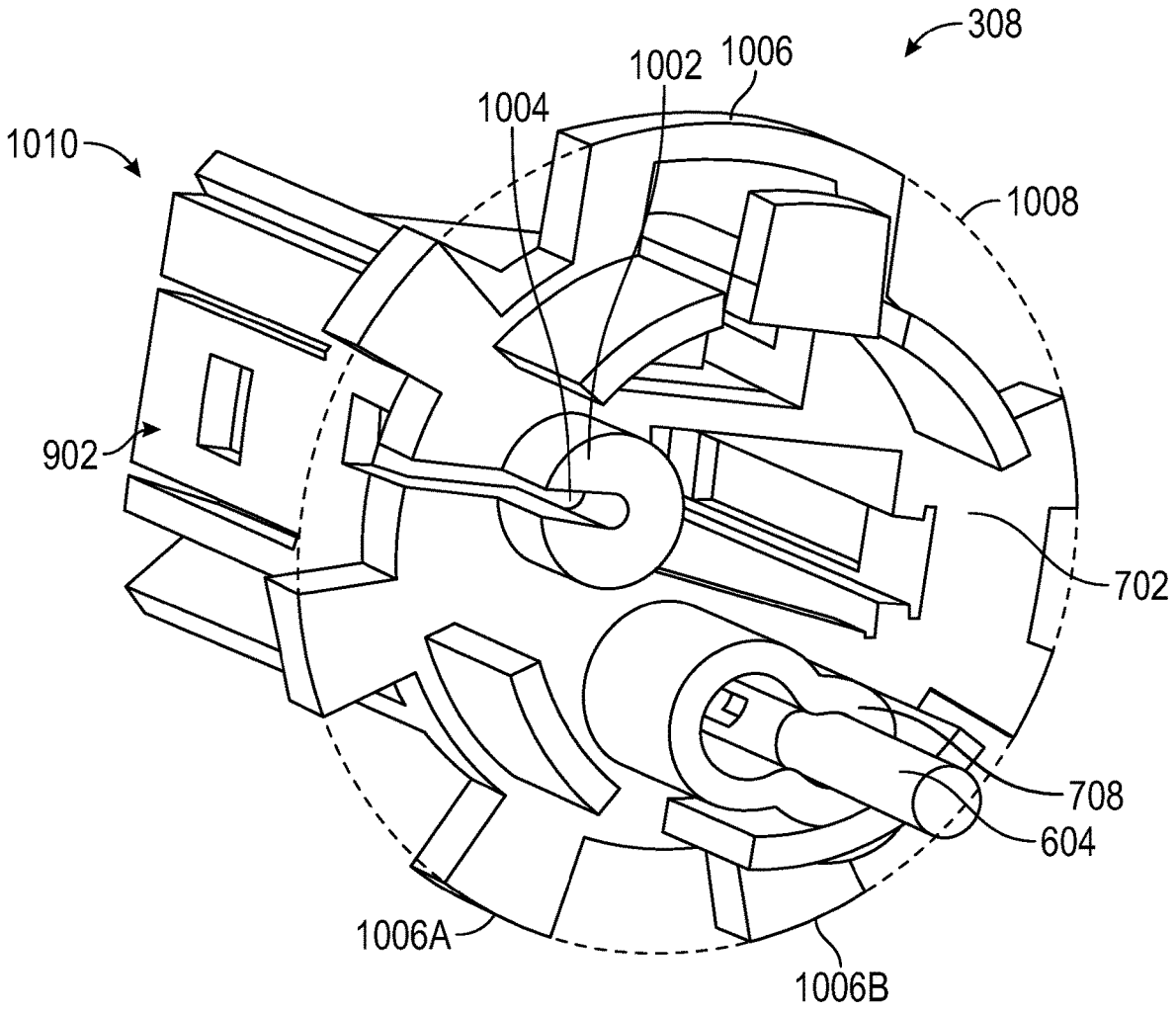
FIG. 10 is a perspective view of the detonator housing facing the proximate end, with the charge tube and other components of FIG. 9 omitted, in accordance with one or more embodiments of the present disclosure.

FIG. 10 is a perspective view of the detonator housing 308 facing the proximate end 702, with the charge tube and other components of FIG. 9 omitted for discussing certain example features of the detonator housing 308, in accordance with one or more embodiments. These other features include a "click-lock" type fastener 902 for releasably securing the housing body 308 within the charge tube 306 of FIGS. 3-9. A raised boss 1002 with a pin hole 1004 is provided for receiving an electrical pin (e.g., "pogo pin") for electrically coupling components of an electrical communication pathway along the perforating gun and/or gun string (e.g., signal conductor(s) 818). The electrical pin may serve to electrically couple one or more electrical conduits (e.g., wires) to an electrical feedthrough of the bulkhead, wherethrough a signal may proceed from gun to gun of the perforating gun assembly 102 (e.g., referring to FIG. 1). A periphery 1006 of the detonator housing 308 may define an outer diameter of the detonator housing 308. The periphery 1006 may include a plurality of non-contiguous peripheral portions, e.g., ears 1006A, 1006B, etc., circumferentially spaced along a generally circular profile indicated by a dashed line at 1008 that may conform to an inner diameter of a charge tube 306 (e.g., referring to FIG. 3) or other tubular or other perforating gun component (e.g., outer diameter of the charge tube 306, inner diameter of the gun body 302, etc.). The end portion 604 of the detonating cord is shown partially inserted into the detonating cord receptacle 708.

As mentioned, a "click-lock" type fastener 1010 may releasably secure the detonator housing body 308 within the charge tube 306 of FIGS. 3-9. The click-lock type fastener 1010, part of which is also visible in each of FIGS. 5, 6, and 9, may be unitarily formed as part of the detonating housing 308, or else made up of one or more separate pieces. The click-lock type fastener 1010 may have a male end 902 to clip into a receiving end (not shown) of the charge tube 306, or vice versa.

Figure 11:
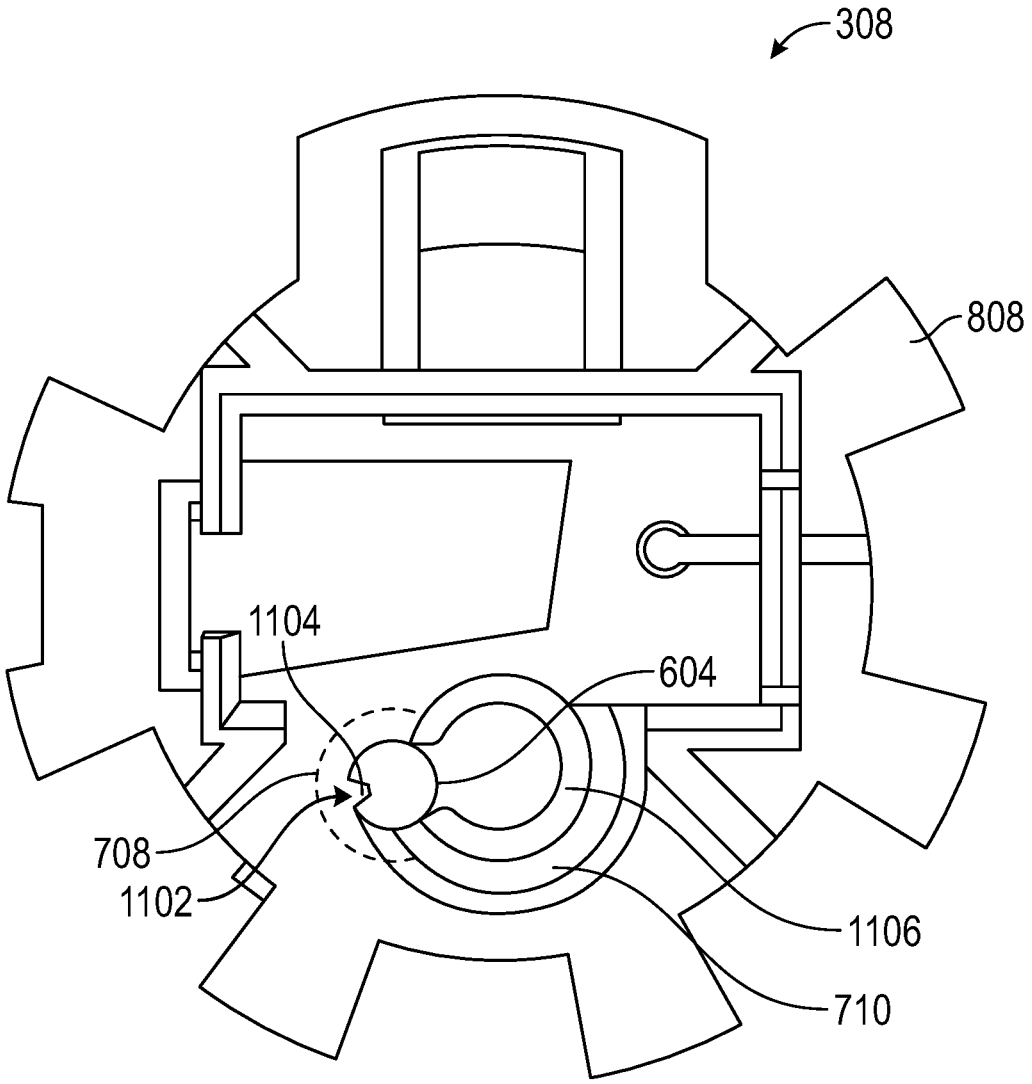
FIG. 11 is an end view of the detonator housing as viewed from the distal end of FIG. 10 with the end portion of the detonating cord inserted for reference, in accordance with one or more embodiments of the present disclosure.

FIG. 11 is an end view of the detonator housing 308 facing the distal end 808 (i.e., flipped around from FIG. 10) with the end portion 604 of the detonating cord inserted for reference, in accordance with one or more embodiments of the present disclosure. This view shows one example configuration of a detonating cord stop 1102 formed on the detonating cord receptacle 708 (shown by a dotted line) to limit an insertion depth of the detonating cord within the detonating cord receptacle 708, i.e., a depth locating feature. The detonating cord stop 1102 comprises a single inward radial protrusion 1104 in this example, but may include additional (i.e., a plurality of) radial protrusions circumferentially spaced around the detonating cord receptacle 708 to limit insertion of the detonating cord 604 from the proximal end 702 of FIG. 10. The radial protrusion 1104 can be unitarily formed as part of the detonating cord housing 308, along with any of the other features, such as by injection molding, additive manufacturing (i.e., 3D printing), or the like. Alternatively, the detonating cord stop 1102 may comprise a separate piece housed within or attached to the detonating cord housing 308, such as but not limited to over molding, fastening, snap fitting, or other methods of joining. The detonator receptacle 710 is shown with the detonator omitted in this view. The detonator receptacle 710 may also include a stop 1106 of any suitable configuration to similarly limit insertion of the detonator from the proximal end 702. In the example shown, the stop 1106 is a depth locating feature similar to detonating cord stop 1102 and is a single circumferential inward protrusion that partially covers the detonator receptacle 710. Partial covering the detonator receptacle 710 with the stop 1106 (e.g., allowing for an unobscured portion) may allow, in some examples, for the assembler to view from the proximate end 702 if the detonator is inserted to its appropriate insertion distance.

Figure 12:
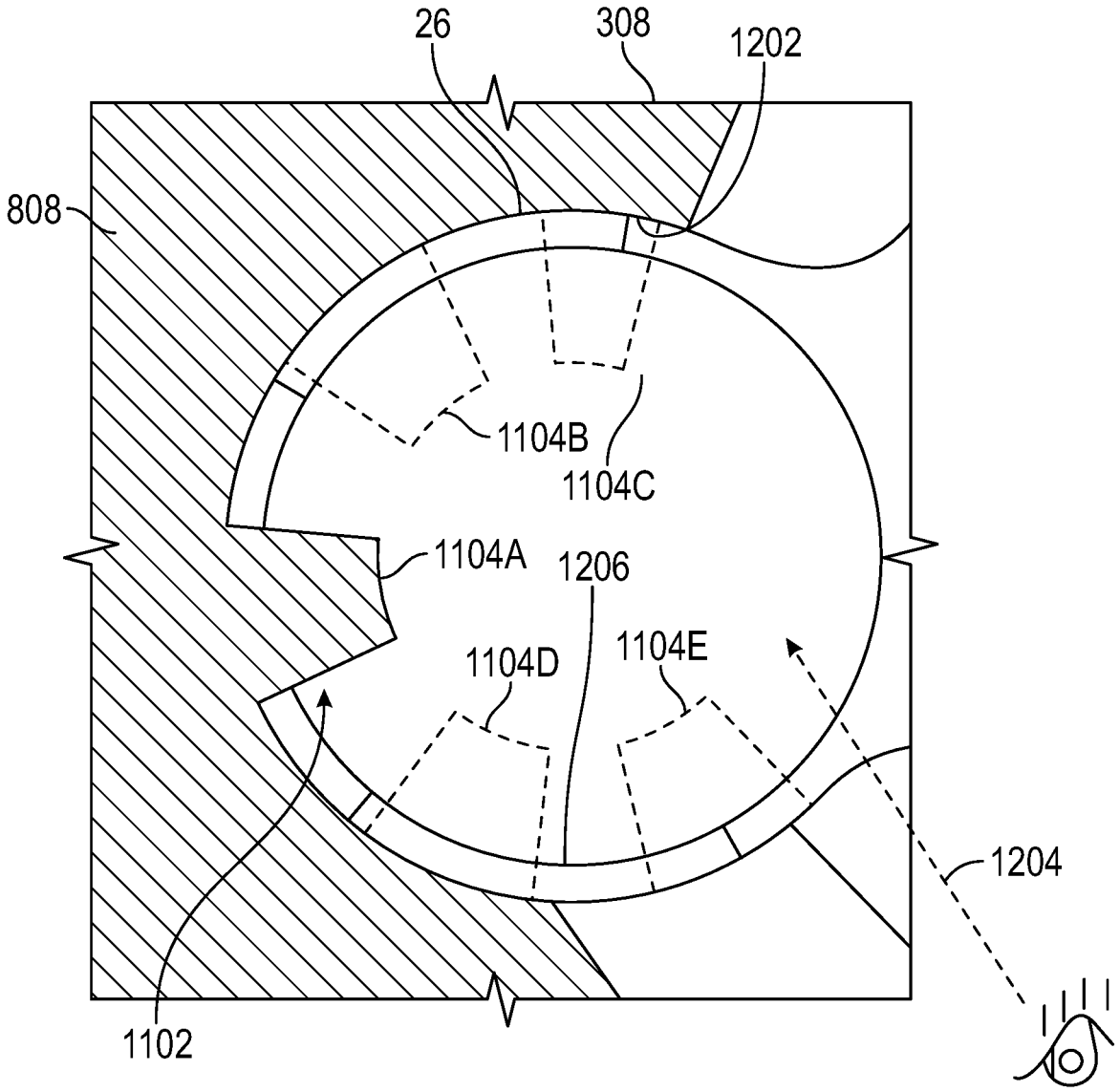
FIG. 12 is an enlarged end view of the detonator housing as viewed from the distal end of FIG. 10, wherein the detonating cord stop comprises one or more inward radial protrusions, in accordance with one or more embodiments of the present disclosure.

FIG. 12 is an enlarged end view of the detonator cord receptacle 708 of detonator housing 308 as viewed from the distal end 808 of FIG. 10, wherein the detonating cord stop 1102 comprises one or more radial protrusions 1104A-1104E to limit the insertion depth of the detonating cord 602, in accordance with one or more examples of the present disclosure. Again, the detonating cord stop 1102 (e.g., referring to FIG. 11) may include as few as one radial protrusion 1104A as shown in solid line type. The detonating cord stop 1102 may alternatively include a plurality of inward radial protrusions, e.g., 1104A-1104E, circumferentially spaced about a circular opening 1202 of the detonating cord receptacle 708. The detonating cord stop 1102 at least partially covers the opening 1202 and has sufficient strength and rigidity to prevent the detonating cord 602 from being easily inserted beyond the detonating cord stop 1102. The portion of the opening 1202 not obscured by the detonating cord stop 1102 provides a second line of sight schematically indicated at 1204, to allow an assembler, as viewing from the distal end 808, to visually confirm when the detonating cord 602 has been fully inserted. Thus, the assembler(s) has/have at least two lines of sight, one from the proximal end and one from the distal end, to help visually confirm seating of at least the detonating cord 602, and optionally, the explosive initiator 810 of the detonator 320 (e.g., referring to FIG. 8).

As another optional feature of the detonating receptacle 708, one or more ribs 1206—in this case, two ribs—are provided to help guide insertion of the detonating cord 602. The ribs 1206 protrude radially far enough into the opening 1202 to frictionally engage the detonating cord 602 while still allowing the detonating cord 602 to be slid beyond the ribs 1206 axially until it engages with the radial protrusion(s) 1104 of the detonating cord stop 1102. The ribs 1206 can help secure the end portion of the detonating cord 602 within the opening 1202, at least by virtue of this frictional engagement, so as to prevent the detonating cord 602 from being accidentally removed from the detonating cord receptacle 708. Preventing accidental removal from detonating cord receptacle 708 may be important, as subsequent detonation of the next perforating gun in a gun string (perforating gun assembly) may be interrupted in some examples by an improperly installed detonating cord 602, resulting in an incomplete detonation of the detonation train. In addition, preventing over-insertion of the detonating cord 602 with the detonating cord stop 1102 may also help ensure good detonation and thus complete detonation of the detonation train by preventing the detonating cord 602 from being inserted too far into detonating cord receptacle 708. For example, if only the end of the detonating cord 602 is the active region of the detonating cord 602, (e.g., due to insulation material wrapped around inactive regions), over-insertion of the detonating cord 602 may similarly result in a failure to detonate just as in the case of insufficient insertion. Another function potentially served by the ribs 1206 is to apply a normal force to the detonating cord 602 when it is side by side with and pressed up against the initiator. This may ensure good contact between the detonating cord 602 and the detonator to ensure good detonation.

Figure 13:
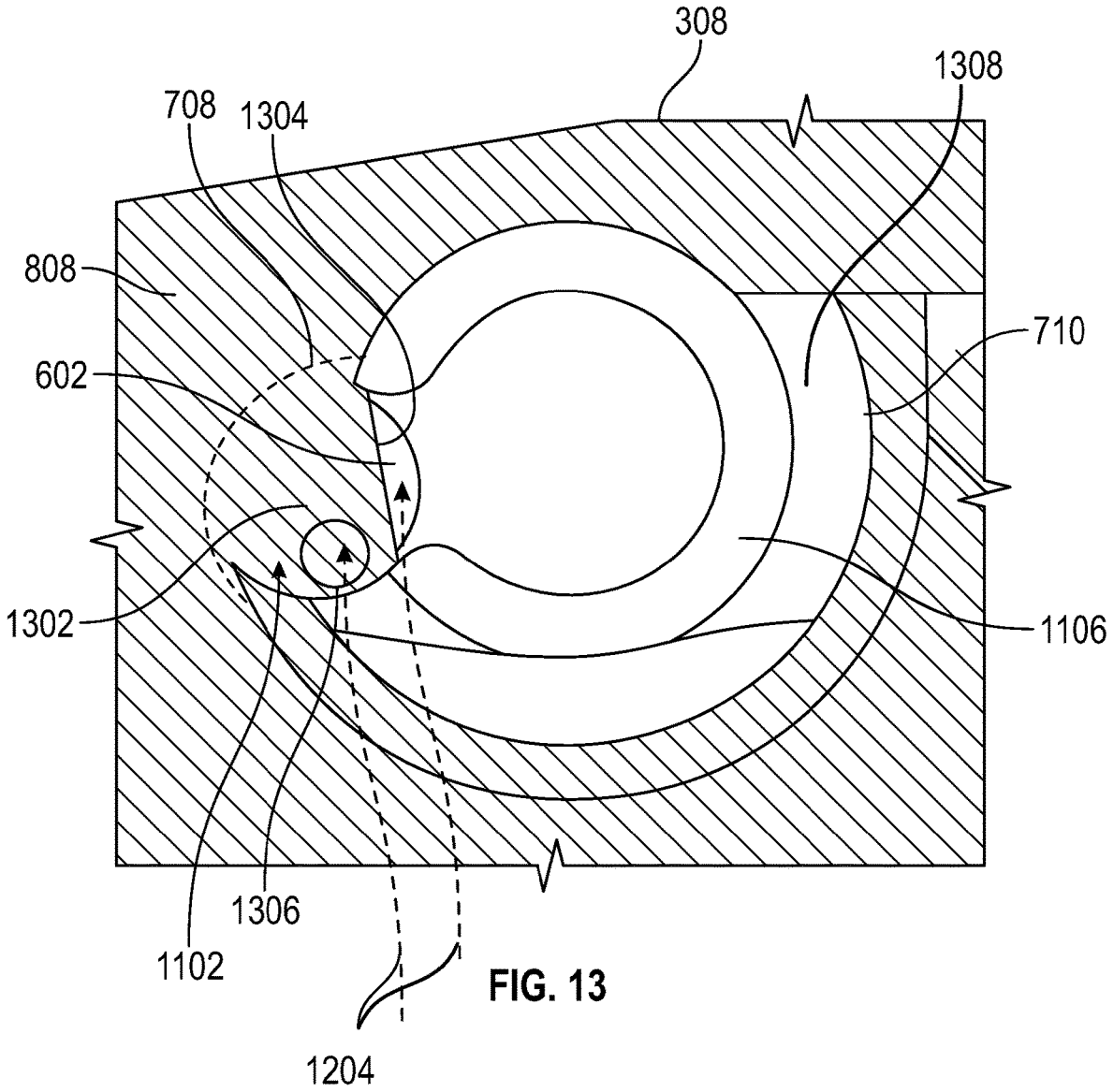
FIG. 13 is an enlarged end view of the detonator housing as viewed from the distal end of FIG. 10, wherein the detonating cord stop comprises one or more thin webs, in accordance with one or more embodiments of the present disclosure.

FIG. 13 is an enlarged end view of the detonator housing 308 as viewed from the distal end 808 of FIG. 10 and showing both detonator cord receptacle 708 and detonator receptacle 710, in accordance with one or more examples of the present disclosure. In the example shown, rather than inward radial protrusion(s) 1104A-1104E (e.g., referring to FIG. 12), the detonating cord stop 1102 alternatively (or additionally) comprises a thin web 1302 that functions in a similar manner to limit insertion of the detonating cord 602 past the detonating cord stop 1102. As with the inward radial protrusion(s) 1104A-1104E, the thin web 1302 has sufficient strength and rigidity to prevent the detonating cord 602 from being easily inserted beyond the detonating cord stop 31. The thin web 1302 may at least partially cover the opening 1202 (e.g., referring to FIG. 12). As illustrated, thin web 1302 may cover the majority of (i.e., at least half of the cross-sectional area of) opening 1202, for additional security against over-insertion. Alternatively, thin web 1302 may cover only a fraction, for example, about 20% to about 90%, or any ranges therebetween, of the cross-sectional area of opening 1202. The web 1302 could, in one or more embodiments, cover the entire opening 1202. However, covering only part of the opening 1202 allows an assembler, as viewing from the distal end 808, to visually confirm when the detonating cord has been fully inserted, as shown by line of sight 1204. For example, thin web 1302 may comprise one or more tapered sections 1304 and/or cut-out sections schematically shown at 1306 to allow for a line of sight 1204 of the detonating cord 602. Thin web 1302 may have any suitable shape. The thickness of the thin web 1302 (i.e., as measured into the plane of the drawing view) may be selected to provide the desired rigidity, for example, about 0.01 millimeters to about 1 centimeter, or any ranges therebetween. Also, as illustrated, the stop 1106 is disposed within an opening 1308 of the detonator receptacle 710, for example, on the end of the detonator receptacle 710 closest to the proximal end 702 (e.g., referring to FIG. 10) of the detonator housing 308.

Figure 14:
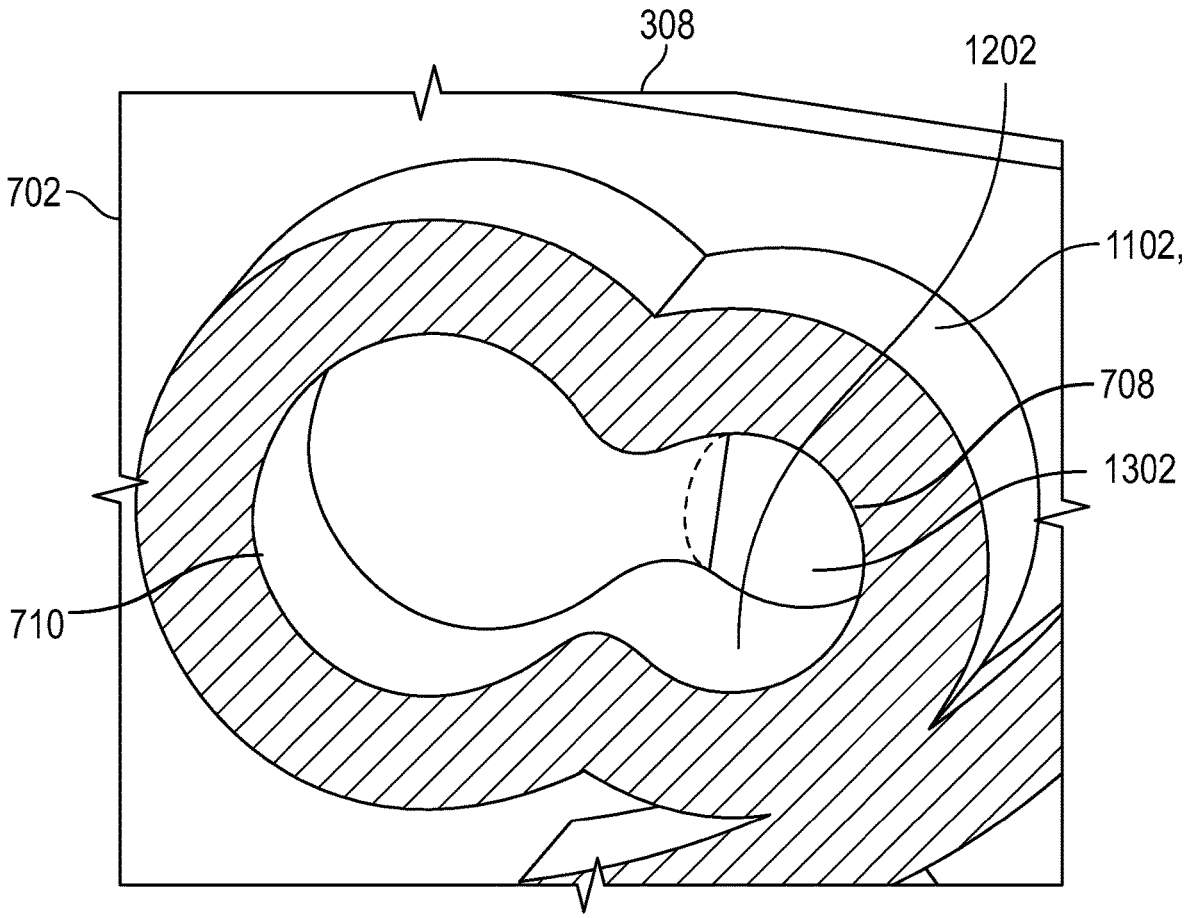
FIG. 14 is an enlarged perspective view of the detonating cord receptacle and detonating cord stop, as viewed from the proximal end of the detonator housing and with the detonating cord omitted for reference, in accordance with one or more embodiments of the present disclosure.

FIG. 14 is an enlarged view of the detonating housing 308 as viewed from the proximal end 702 (e.g., inside the gun body) and showing both detonator cord receptacle 708 and detonator receptacle 710, in accordance with one or more examples of the present disclosure. This example shows one example configuration of the detonating cord receptacle 708 shown in FIG. 13 wherein the detonating cord stop 1102 comprises a thin web 1302 extending radially inwardly to cover a majority of the opening 1202 of the detonating cord receptacle 708. This thin web 1302 covers at least part of the opening sufficient to prevent the detonating cord from being inserted past the thin web 1302 in an insertion direction from the proximal end 702 toward the distal end.

As illustrated, the cross-sectional area of detonator cord receptacle 708 is smaller than that of the detonator receptacle 710. This is due to the fact that in some examples, the circumference of the detonator is larger than that of the detonating cord 602, and the two are meant to fit snugly against each other in their respective receptacles 708, 710. However, it is contemplated that in the event that detonation is performed with a smaller explosive initiator 810 (e.g., referring to FIG. 8), the cross-sectional area of the detonator cord receptacle 708 may be larger than that of the detonator receptacle 710 to ensure proper side by side detonation. Also, while not illustrated, the one or more ribs 1206 shown and described in FIG. 12 may also be present within opening 1202, e.g., when the thin web 1302 is used instead of or in addition to the one or more inward radial protrusion(s) 1104A-1104E (e.g., referring to FIG. 12), for providing frictional engagement to the detonating cord 602. Likewise, while not shown, similar ribs may be used within the detonator receptacle 710 to frictionally engage the explosive initiator 810 to ensure reliable seating of the detonator within the detonator housing 308.

Accordingly, the present disclosure may provide a detonator housing for a perforating gun and related apparatus, systems, and methods, incorporating a detonating cord stop feature to limit insertion of the detonating cord. The detonating cord stop may comprise any suitable configuration that limits insertion of the detonating cord, while still allowing visual confirmation that the detonating cord has been seated. The examples of one or more radial protrusions, a web, etc., are non-limiting as other suitable shapes are also considered within the scope of this disclosure. The detonating cord stop can be made by molding, such as unitarily forming by injection molding, or can be made from other methods apart from injection molding, such as over molding, fastening, snap fit or other methods of joining. The detonating cord stop can be fabricated as a single piece, or alternatively, as two or more pieces joined together. The methods, systems, and tools may include any of the various features disclosed herein, including one or more of the following statements.

Statement 1: A detonator housing, comprising: a housing body configured for coupling to a charge tube of a perforating gun; a detonator receptacle formed on the housing body for receiving a detonator; a detonating cord receptacle formed on the housing body adjacent the detonator receptacle, the detonating cord receptacle for receiving an end portion of a detonating cord in an overlapping relationship with the detonator received by the detonator receptacle; and a detonating cord stop formed on the detonating cord receptacle to limit an insertion depth of the detonating cord within the detonating cord receptacle.

Statement 2: The detonator housing of statement 1, wherein the detonator receptacle and cord receptacle are oppositely facing to receive the detonator and detonating cord from opposing insertion directions.

Statement 3: The detonator housing of statement 2, wherein the housing body of the detonator housing comprises a proximal end on which the detonating cord receptacle is formed, a distal end on which the detonator receptacle is formed, and a window providing a line of sight through the housing body from the distal end toward the proximal end for visually confirming the detonating cord is fully seated in the detonating cord receptacle.

Statement 4: The detonator housing of any of statements 1-3, further comprising a rib formed on an interior of the detonating cord receptacle axially spaced along the detonating cord receptacle from the detonating cord stop, the rib positioned to frictionally engage the detonating cord as the detonating cord is inserted beyond the rib into engagement with the detonating cord stop.

Statement 5: The detonator housing of any of statements 1-4, wherein the detonating cord stop comprises one or more radial protrusions that prevent the detonating cord from moving past the detonating cord stop.

Statement 6: The detonator housing of any of statements 1-5, wherein the detonating cord stop comprises a thin web extending radially inwardly to cover a majority of an opening of the detonating cord receptacle.

Statement 7: The detonator housing of any of statements 1-6, wherein the detonating cord stop comprises two or more pieces joined together.

Statement 8: The detonator housing of any of statements 1-7, wherein the detonating cord stop is unitarily formed with the housing body of the detonator housing by injection molding.

Statement 9: The detonator housing of any of statements 1-8, wherein the detonating cord stop is separately formed and secured to the housing body.

Statement 10: The detonator housing of any of statements 1-9, wherein the housing body comprises a click-lock fastener configured for releasably securing the housing body to the charge tube.

Statement 11: A perforating gun, comprising: a charge tube for securing a plurality of perforating charges at different positions and firing orientations; a detonator; a detonating cord; and a detonator housing securable to an end of the charge tube, the detonator housing including a detonator receptacle for receiving the detonator, a detonating cord receptacle adjacent the detonator receptacle for receiving an end portion of the detonating cord in an overlapping relationship with the detonator, and a detonating cord stop to limit an insertion depth of the detonating cord within the detonating cord receptacle.

Statement 12: The perforating gun of statement 11, wherein the housing body of the detonator housing comprises a proximal end on which the detonating cord receptacle is formed and a distal end on which the detonator receptacle is formed, wherein the detonator receptacle and cord receptacle are oppositely facing to receive the detonator and detonating cord from opposing insertion directions, and a window providing a line of sight through the housing body from the distal end toward the proximal end for visually confirming the detonating cord is fully seated in the detonating cord receptacle.

Statement 13: The perforating gun of statements 1 or 2, further comprising a rib formed on an interior of the detonating cord receptacle axially spaced along the detonating cord receptacle from the detonating cord stop, the rib positioned to frictionally engage the detonating cord as the detonating cord is inserted beyond the rib into engagement with the detonating cord stop.

Statement 14: The perforating gun of any of statements 11-13, wherein the detonating cord stop comprises one or more radial protrusions or a thin web that prevent the detonating cord from moving past the detonating cord stop, wherein the detonating cord stop covers a majority of an opening of the detonating cord receptacle, and a remaining portion of the opening is uncovered to visually confirm when the detonating cord is inserted into the detonating cord receptacle.

Statement 15: The perforating gun of any of statements 11-14, wherein the detonating cord stop is unitarily formed with the housing body of the perforating gun by injection molding.

Statement 16: The perforating gun of any of statements 11-15, wherein the detonating cord stop is separately formed and secured to the housing body.

Statement 17: The perforating gun of any of statements 11-16, wherein the housing body comprises a click-lock fastener configured for releasably securing the housing body to the charge tube.

Statement 18: A method of assembling a perforating gun, the method comprising: securing a plurality of perforating charges at different positions and firing orientations along a charge tube; securing a detonator housing to an end of the charge tube, the detonator housing including a detonator receptacle, a detonating cord receptacle adjacent the detonator receptacle, and a detonating cord stop; inserting the detonator into the detonator receptacle; inserting an end portion of the detonating cord into the detonating cord receptacle to position the detonating cord in an overlapping relationship with the detonator, while limiting an insertion depth of the detonating cord within the detonating cord receptacle using the detonating cord stop.

Statement 19: The method of statement 18, further comprising inserting the detonator and detonating cord in opposing insertion directions; and visually confirming when the detonating cord is fully seated within the detonating cord receptacle along a line of sight through one or more window on the housing body.

Statement 20: The method of statement 18 or 19, further comprising frictionally engaging the detonating cord with one or more ribs as the detonating cord is inserted into engagement with the detonating cord stop.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A detonator housing, comprising:

a housing body configured for coupling to a charge tube of a perforating gun;

a detonator receptacle formed on the housing body for receiving a detonator;

a detonating cord receptacle formed on the housing body adjacent the detonator receptacle, the detonating cord receptacle for receiving an end portion of a detonating cord in an overlapping relationship with the detonator received by the detonator receptacle; and a detonating cord stop formed on the detonating cord receptacle to limit an insertion depth of the detonating cord within the detonating cord receptacle, wherein the detonating cord stop covers a majority of an opening of the detonating cord receptacle, and a remaining portion of the opening is uncovered to visually confirm when the detonating cord is inserted into the detonating cord receptacle.

2. The detonator housing of claim 1, wherein the detonator receptacle and cord receptacle are oppositely facing to receive the detonator and detonating cord from opposing insertion directions.

3. The detonator housing of claim 2, wherein the housing body of the detonator housing comprises a proximal end on which the detonating cord receptacle is formed, a distal end on which the detonator receptacle is formed, and a window providing a line of sight through the housing body from the distal end toward the proximal end for visually confirming the detonating cord is fully seated in the detonating cord receptacle.

4. The detonator housing of claim 1, further comprising a rib formed on an interior of the detonating cord receptacle axially spaced along the detonating cord receptacle from the detonating cord stop, the rib positioned to frictionally engage the detonating cord as the detonating cord is inserted beyond the rib into engagement with the detonating cord stop.

5. The detonator housing of claim 1, wherein the detonating cord stop comprises one or more radial protrusions that prevent the detonating cord from moving past the detonating cord stop.

6. The detonator housing of claim 1, wherein the detonating cord stop comprises a thin web extending radially inwardly to cover a majority of an opening of the detonating cord receptacle.

7. The detonator housing of claim 1, wherein the detonating cord stop comprises two or more pieces joined together.

8. The detonator housing of claim 1, wherein the detonating cord stop is unitarily formed with the housing body of the detonator housing by injection molding.

9. The detonator housing of claim 1, wherein the detonating cord stop is separately formed and secured to the housing body.

10. The detonator housing of claim 1, wherein the housing body comprises a click-lock fastener configured for releasably securing the housing body to the charge tube.

11. A perforating gun, comprising:

a charge tube for securing a plurality of perforating charges at different positions and firing orientations;

a detonator;

a detonating cord; and a detonator housing securable to an end of the charge tube, the detonator housing including a detonator receptacle for receiving the detonator, a detonating cord receptacle adjacent the detonator receptacle for receiving an end portion of the detonating cord in an overlapping relationship with the detonator, and a detonating cord stop to limit an insertion depth of the detonating cord within the detonating cord receptacle, wherein the detonating cord stop covers a majority of an opening of the detonating cord receptacle, and a remaining portion of the opening is uncovered to visually confirm when the detonating cord is inserted into the detonating cord receptacle.

12. The perforating gun of claim 11, wherein a housing body of the detonator housing comprises a proximal end on which the detonating cord receptacle is formed and a distal end on which the detonator receptacle is formed, wherein the detonator receptacle and cord receptacle are oppositely facing to receive the detonator and detonating cord from opposing insertion directions, and a window providing a line of sight through the housing body from the distal end toward the proximal end for visually confirming the detonating cord is fully seated in the detonating cord receptacle.

13. The perforating gun of claim 11, further comprising a rib formed on an interior of the detonating cord receptacle axially spaced along the detonating cord receptacle from the detonating cord stop, the rib positioned to frictionally engage the detonating cord as the detonating cord is inserted beyond the rib into engagement with the detonating cord stop.

14. The perforating gun of claim 11, wherein the detonating cord stop comprises one or more radial protrusions or a thin web that prevent the detonating cord from moving past the detonating cord stop.

15. The perforating gun of claim 11, wherein the detonating cord stop is unitarily formed with a housing body of the perforating gun by injection molding.

16. The perforating gun of claim 11, wherein the detonating cord stop is separately formed and secured to a housing body.

17. The perforating gun of claim 11, wherein a housing body comprises a click-lock fastener configured for releasably securing the housing body to the charge tube.

18. A method of assembling a perforating gun, the method comprising: securing a plurality of perforating charges at different positions and firing orientations along a charge tube;

securing a detonator housing to an end of the charge tube, the detonator housing including a detonator receptacle, a detonating cord receptacle adjacent the detonator receptacle, and a detonating cord stop;

inserting the detonator into the detonator receptacle; and inserting an end portion of the detonating cord into the detonating cord receptacle in opposing insertion direction to the detonator to position the detonating cord in an overlapping relationship with the detonator, while limiting an insertion depth of the detonating cord within the detonating cord receptacle using the detonating cord stop; and visually confirming when the detonating cord is fully seated within the detonating cord receptacle along a line of sight through one or more window on a housing body.

19. The method of claim 18, further comprising frictionally engaging the detonating cord with one or more ribs as the detonating cord is inserted into engagement with the detonating cord stop.

* * * * *